US006267449B1

(12) United States Patent
Meya et al.

(10) Patent No.: US 6,267,449 B1
(45) Date of Patent: Jul. 31, 2001

(54) GUIDE ARRANGEMENT FOR A DRUM-TYPE MINERAL CUTTING MACHINE

(75) Inventors: Hans Meya, Werne; Gerhard Merten, Lünen, both of (DE)

(73) Assignee: DBT Deutche Bergbau-Technik GmbH (DE)

( * ) Notice: Subject to any disclaimer, the term of this patent is extended or adjusted under 35 U.S.C. 154(b) by 0 days.

(21) Appl. No.: 09/398,495

(22) Filed: Sep. 17, 1999

(30) Foreign Application Priority Data

Sep. 25, 1998 (DE) ..... 198 44 052

(51) Int. Cl.[7] ..... E21C 29/22
(52) U.S. Cl. ..... 299/43
(58) Field of Search ..... 299/80.1, 42, 43, 299/45, 48, 51, 52, 53, 54

(56) References Cited

U.S. PATENT DOCUMENTS 3,954,299 * 5/1976 Hartley ..... 299/43
5,704,267 * 1/1998 Merten et al. ..... 83/823

FOREIGN PATENT DOCUMENTS

2552085 A1 * 5/1977 (DE) .
25 52 085 C3 7/1980 (DE) .
26 46 291 9/1980 (DE) .
29 25 240 1/1981 (DE) .
2925240 A1 * 1/1981 (DE) .
196 33 491 A1 2/1998 (DE) .

OTHER PUBLICATIONS

Abstract of Utility Model No. 6802117 (Oct. 12, 1968); German Utility Model Register; Book 5, Class 5, p. 261, Jan. 30, 1969.

* cited by examiner

*Primary Examiner*—David Bagnell
*Assistant Examiner*—John Kreck
(74) *Attorney, Agent, or Firm*—Samuels, Gauthier & Stevens

(57) ABSTRACT

A guide arrangement for a drum-type cutting machine is composed of a guide block cooperating with a guide rail and articulated at the lower end of a vertical guide arm of the cutting machine. The guide block has a pocket defined by lateral walls which receives the guide arm. A transverse bolt extends through the pocket in the guide block and is received snugly by a bore in the guide arm. One of the end regions of the bolt forms a pivot journal head with curved surfaces which is received in a pivot journal socket in one of the lateral walls of the pocket in the guide block. The other end of the transverse bolt fits with lateral play in a horizontal guide of the other lateral wall of the guide block. The inner surfaces of the lateral walls incline relative to a horizontal plane to permit the guide arm to cant about a vertical axis.

22 Claims, 4 Drawing Sheets

FIG.2
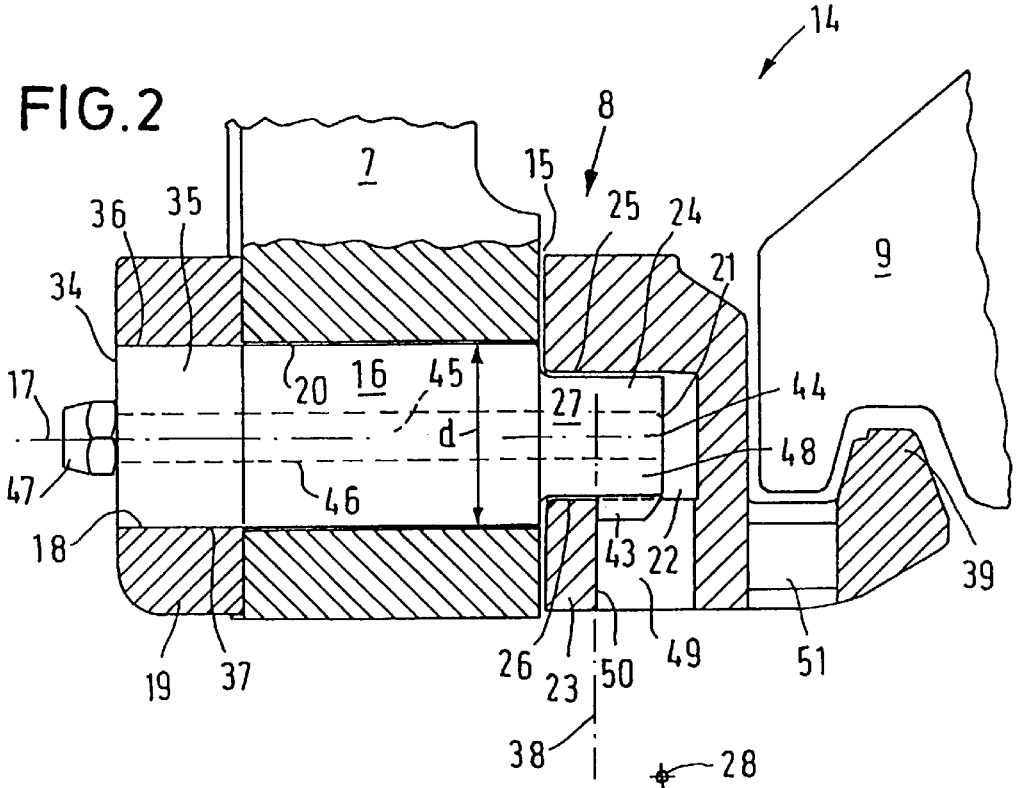
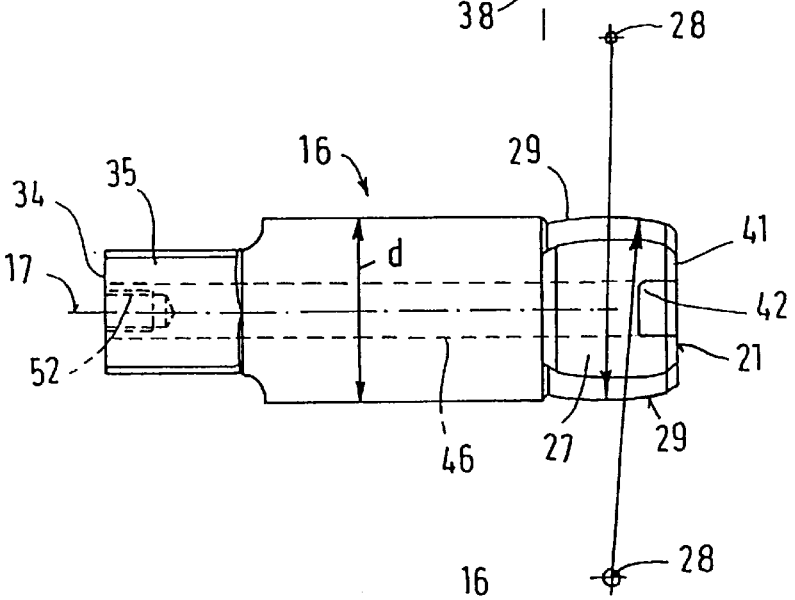
FIG.5
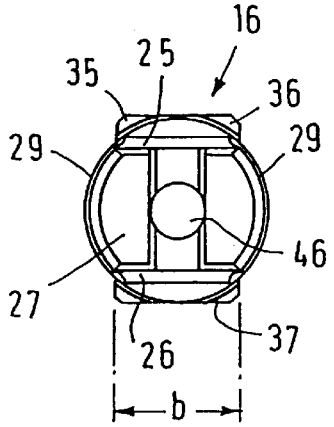
FIG.6

GUIDE ARRANGEMENT FOR A DRUM-TYPE MINERAL CUTTING MACHINE

FIELD OF THE INVENTION

The invention relates in general to mineral mining installations and, more particularly, to a guide arrangement for a drum-type mineral cutting machine usable, for example, in coal mining installations.

BACKGROUND OF THE INVENTION

In mineral mining installations it is well known to mount a drum-type cutting machine, such as a shearer, on a conveyor extending alongside a mineral, e.g. coal, face. The machine has a drive motor which rotates a toothed sprocket wheel which meshes with a stationary track, such as a chain, on the goaf side of the conveyor remote from the mineral face. As the sprocket wheel rotates the machine is driven back and forth above the conveyor to strip mineral from the mineral face with a rotating cutting drum and the conveyor then transports the mineral with a circulating scraper-chain assembly. To support and guide the machine a floor rail on the mineral face side of the conveyor supports running wheels whilst at the opposite goaf side the machine has vertically depending guide arms fitted with guide blocks which co-operate with guide projections slidably engaging in a guide rail supported on the conveyor. The guide blocks can clasp the guide rail substantially in the manner of a hook from above and/or below (see DE-PS 25 52 085, DE-PS 26 46 291, DE-OS 29 25 240).

In order to adapt the guide blocks to the course of the conveyor which is not normally horizontal, the guide blocks are mounted on the guide arms of the cutting machine so as to be pivotal in height to a limited extent by means of horizontal transverse bolts.

In order not only to provide compensation if the horizontal is not level, which is achieved by the pivotability of the guide block about a horizontal axis, but also to prevent jamming of the guide blocks when the conveyor does not extend exactly rectilinearly but adopts a curved course, for example if the individual conveyor pans snake, it is also already known additionally to make the guide blocks pivot around a vertical axis on the guide arm. Thus for this purpose the guide blocks according to DE-OS 196 33 491 are each provided with a vertical journal with which it is mounted so as to pivot rotatably to a limited extent in a journal socket on the guide arm. This known arrangement allows part rotation or pivoting of the guide block around a vertical as well as a horizontal axis in the manner of a universal joint so locking or clamping of the guide block and the guide rail can be substantially avoided. Nevertheless it has been found that, with the dimensions of the guide arm normally used, the forces occurring during cutting can barely be controlled with the known arrangement. Moreover, with a conventional material thickness of the guide arm of 120 mm and the necessary diameter of the vertical journal of 60 mm, there is a risk that the vertical bore on the guide arm will break out or deform and therefore will no longer be capable of holding the guide block with the necessary reliability.

A guide arrangement is known from DE-GM 68 02 117. In this arrangement a transverse bolt is held rigidly in the guide arm and tapers at the two outer ends projecting from the guide arm substantially frusto-conically to the ends. These frusto-conically converging portions of the transverse bolt are held in cylindrical bores in the guide block with ample play and, owing to their configuration, allow limited pivotability of the guide block relative to the guide arm of the cutting machine both vertically and horizontally. The disadvantage of this arrangement resides mainly in the fact that guide block and transverse bolt only make loose contact with one another in each direction and this results in enormously high wear of the components because the transverse bolt can only be applied after overcoming the play existing on the respectively opposed surface regions of the bores in the guide block during each change of direction of travel. A further disadvantage of this arrangement is that the guide block can move not only in the vertical direction and the desired horizontal direction transversely to the direction of travel of the cutting machine but also in a horizontal direction parallel to the direction of travel of the cutting machine. As a result, the guide projection can more easily become disengaged from the guide rail arranged on the conveyor and reliable guidance of the machine is no longer ensured.

SUMMARY OF THE INVENTION

It is an object of the invention to avoid the aforementioned disadvantages and to provide a guide arrangement of the type mentioned at the outset which ensures good vertical and horizontal guidance of the cutting machine without leading to unacceptably high wear in the connection region between the guide block and guide arm.

Another object of the invention is to avoid problems occurring as a result of the predetermined dimensions of the guide arms when using a separate vertical journal of the type known in the art.

In accordance with the invention an improved guide arrangement comprises a guide block which is pivotally connected on a guide arm of the cutting machine for movement around a horizontal and a vertical axis and co-operates with a guide rail arranged on the conveyor. The guide arm fits into a pocket on the guide block and is secured therein by means of a transverse bolt. A pivot journal head is formed at one end region of the transverse bolt and the head is received pivotally relative to the guide block around a vertical axis in a pivot journal socket in a lateral wall of the pocket. A horizontal guide in the other lateral wall of the pocket receives the other end region of the transverse bolt with lateral play.

With such an arrangement, the pivotability of the guide block around the horizontal axis transversely to the direction of travel of the machine is brought about by the transverse bolt which can be simply plugged into a bearing bore on the guide arm and is held rotatably and snugly therein. The pivotability around the vertical axis is brought about by the particular holding of the transverse bolt in the lateral walls of the pocket formed in the guide block. The end of the transverse bolt forming the pivot journal head of the transverse bolt is held rotatably around the vertical axis but otherwise substantially non-displaceably in the associated pivot journal socket, like a ball in a ball socket, whereas the other end of the transverse bolt can move to and fro in the direction of travel of the cutting machine in the horizontal guide. In contrast to the state of the art, the vertical pivot axis here does not extend through the guide arm of the cutting machine but is offset to the side of it. If the pivot journal socket is arranged on the goaf-side of the guide block in the vicinity of its guide projection, it is possible with the invention in a quite exceptionally advantageous manner to bring the vertical axis of rotation into close spatial proximity with the guide projection making guide engagement with the guide rail so that the constraining forces, which also occur with the articulated mounting of the guide block, between the conveyor and the cutting machine can be minimised.

The pivot journal head preferably comprises lateral guide faces which are curved convexly so that it can pivot freely in the pivot journal socket and therefore always has at least linear contact with one side of the pivot journal socket. The pivot journal head and the pivot journal socket are preferably flattened in each case on their upper and lower sides, in other words at the roof and floor planes to ensure that the transverse bolt cannot rotate around its axis in the journal socket itself and also to prevent pivoting around a horizontal axis parallel to the direction of travel of the machine.

The pivot journal socket can be provided on its underside with at least one outlet orifice through which fine dust entering the socket can be discharged.

The transverse bolt is expediently secured in the pivot journal socket by means of a securing element which particularly advantageously consists substantially of a locking element which is arranged on the pivot journal head, to fit into the outlet orifice and comes into contact with a lateral wall of the outlet orifice during unintentional extraction or migration of the transverse bolt from the bearing bore on the guide arm or the pivot journal socket on the guide block and therefore positively prevents further extraction.

The transverse bolt preferably forms, at its end fitting in the horizontal guide, a sliding block which is flattened at the top and bottom and is laterally displaceable in the horizontal guide.

The lateral walls of the pocket confronting the guide arm preferably form inclined contact faces. It is particularly advantageous if the length of the horizontal guide and the angle of the contact faces are so dimensioned that, during the pivoting of the guide block around the vertical axis, the guide arm with its lateral faces comes into contact with some of the contact faces before the end of the transverse bolt sliding in the horizontal guide strikes a leading or trailing end of the horizontal guide. This design ensures that no forces are transmitted horizontally between the horizontal guide arranged on the mineral face-side of the guide block and the end of the transverse bolt which is displaceable to and fro therein, because they are absorbed completely by the lateral faces of the guide arm resting on the contact faces of the pocket. The horizontal guide and the sliding block of the transverse bolt displaceable therein can therefore be comparatively small in size.

The pocket preferably has orifices for discharging fine dust which are expediently arranged in its interior space. Such a measure not only allows reliable discharge of the fine dust which would otherwise collect in the pocket but also advantageously reduces the weight of the guide block.

The pivot journal socket can be designed in the form of a blind orifice in the associated lateral wall of the pocket so that the pivot journal socket is substantially closed and the admission of dust into the socket is minimised.

In an advantageous development of the invention, the pivot journal head has a substantially vertically extending holding groove for the locking element which can be designed in the form of a hammer head screw the head of which is positively arranged in the holding groove. The transverse bolt can expediently be provided with a central through-bore for receiving the fastening screw bolt of the locking element which can then be clamped with a nut. The nut is released particularly easily from the side of the horizontal guide, that is from the mineral face-side.

The transverse bolt can preferably be coupled at its end received in the horizontal guide to a bolt extractor which can be connected to the bolt end face and, for this purpose, can preferably be screwed on an extraction thread arranged on the bolt end face. It is then possible to fix the extractor on the fastening screw bolt and to pull the transverse bolt from the bearing bore once the locking element has been disengaged from the outlet orifice of the pivot journal socket.

The vertical height of the transverse bolt end with the sliding block held in the horizontal guide is preferably at least as great as the diameter of the transverse bolt in the region of the bearing bore in the guide arm. The transverse bolt can then easily be inserted from the side of the horizontal guide for assembly of the guide block on the guide arm with its pivot journal head passing through the bearing bore into the pivot journal socket and can subsequently be locked therein.

The guide faces of the pivot journal head are preferably also curved around the axis of the transverse bolt whereas the pivot journal socket forms lateral bearing faces for supporting the pivot journal guide faces which have a curvature adapted to the curvature of the guide faces. This configuration of pivot journal head and pivot journal socket allows problem-free transmission even of high intermittent loads of the type which can occur during operation.

The guide block can be produced in one piece from cast steel and can preferably be used without further mechanical treatment.

The invention may be understood more readily, and further features and advantages of the invention may become apparent from the following description.

BRIEF DESCRIPTION OF THE DRAWINGS

An embodiment of the invention will now be described, by way of example only, with reference to the accompanying drawings, wherein:

FIG. 2 is a cross section of a guide block of the guide arrangement connected to a guide arm of the drum cutting machine, the view being taken on a somewhat larger scale to FIG. 1;

FIG. 5 is a plan view of a transverse bolt of the guide arrangement serving to connect the guide block to the guide arm and FIG. 6 is a view taken in the direction of arrow VI in FIG. 5.

DESCRIPTION OF PREFERRED EMBODIMENT

Figure 1:
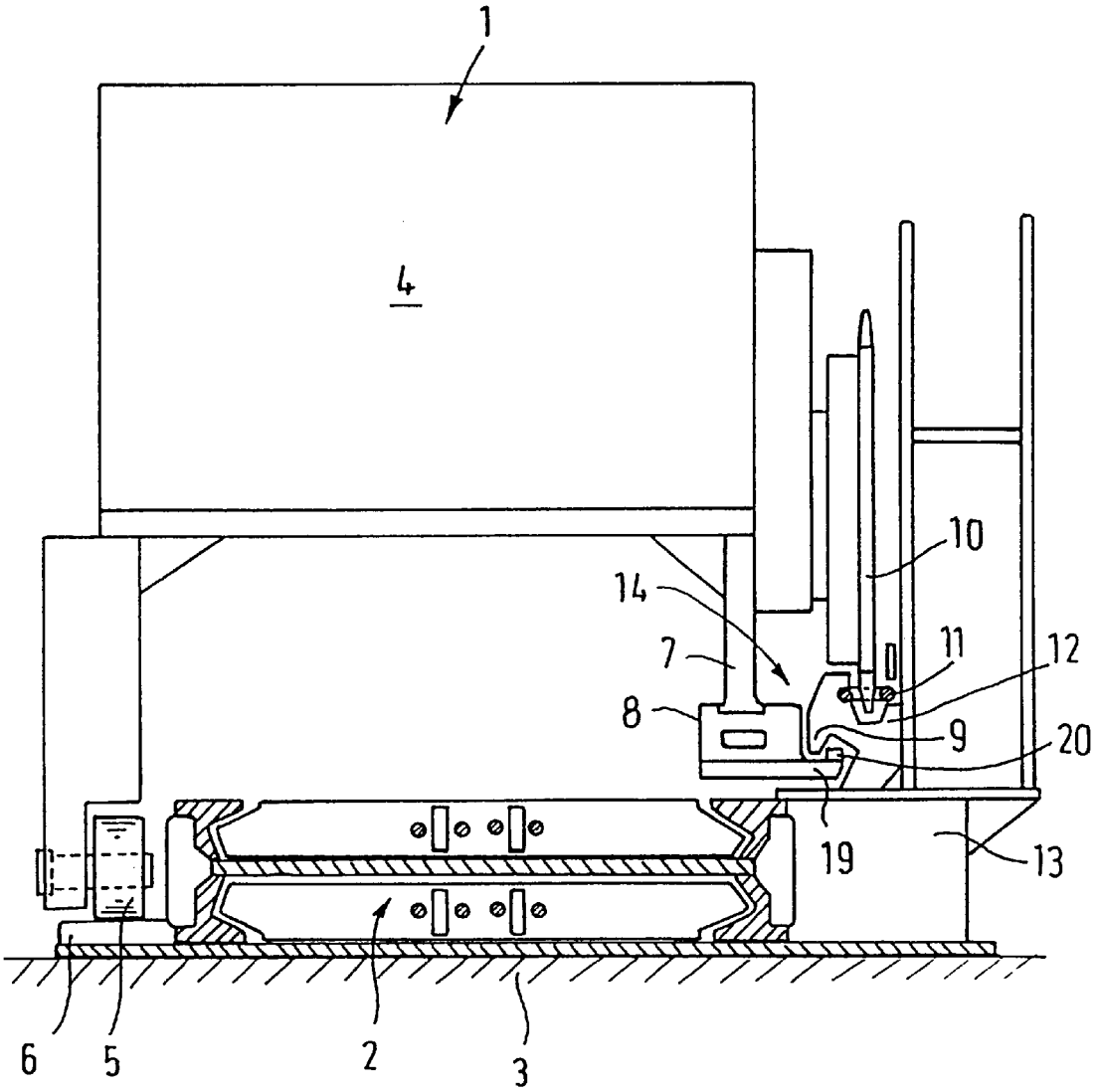
FIG. 1 is a part-sectional schematic representation of a mineral mining installation with a drum-type cutting machine together with a conveyor and a guide arrangement constructed in accordance with the invention as viewed in the longitudinal direction of the conveyor.

FIG. 1 is a schematic representation of a mining installation of the type known per se with a shearer or drum-type cutting machine 1 and a conveyor 2 which is arranged in an underground working alongside a mineral, e.g. coal face, (not shown) on the floor of the working. Essentially only the body 4 of the machine 1 is shown which spans the conveyor 2 in the manner of a bridge and is capable of travelling on its mineral face-side with wheels 5 on a floor rail 6. The floor rail 6 extends in the longitudinal direction of the face and is rigidly mounted laterally on the conveyor 2. The body 4 would mount a rotatable cutting drum (not shown) which serves to strip mineral from the mineral face as the machine 1 is moved along the conveyor 2. On the opposing goaf-side of the conveyor, the machine body 4 is provided, at its leading and trailing end, with a respective vertically depending guide arm 7. At the lower end of each arm 7 there is pivotally connected a guide block 8 which leads with a guide projection 39 into a channel 20 in a guide rail 9 in the manner of a hook.

The machine body 4 has a drive shaft for advancing the cutting machine 1. The drive shaft drives a toothed sprocket wheel 10 engaging with a rack 11 or a stationary chain mounted in another channel formed in the guide rail 9. The guide rail 9 is rigidly arranged on upstanding supports 13 connected to the conveyor 2 on the goaf-side.

The conveyor 2 is a scraper-chain conveyor with individual conveyor troughs or conveyor pans articulated to one another for slight vertical and horizontal mobility and a scraper-chain assembly is circulated along the pans in upper and lower runs.

Installations of the type shown in FIG. 1 and described briefly hereinbefore are known in many designs and have already been used for a long time in underground mining. The present invention relates to the particular guide arrangement of the machine 1 composed of the guide blocks 8 connected to the guide arms 7 and cooperating with the guide rail 9.

As shown in FIG. 2, in the guide arrangement 14 according to the invention, the guide arm 7 is received in a pocket 15 provided in the guide block 8 and is articulated to the guide block 8 by means of a transverse bolt 16 in such a way that the guide block 8 can pivot relative to the guide arm 7 around a horizontal axis 17 extending transversely to the direction of travel of the cutting machine 1. For this purpose, the transverse bolt 16 is placed from the mineral face-side of the machine 1 though a suitable orifice 18 in a mineral face-side lateral wall 19 of the guide block 8 laterally limiting the pocket 15 and through a bearing bore 20 in the guide arm 7. The goaf-side end region 21 of the transverse bolt 16 forms a pivot journal head 27 which fits into a suitable pivot journal socket 22 in the goaf-side lateral wall 23 of the pocket 15 of the guide block 8. The bearing bore 20 has a slightly greater diameter than the transverse bolt 16 in the corresponding central region, so the bolt 16 can rotate freely in the bearing bore 20.

Figure 3:
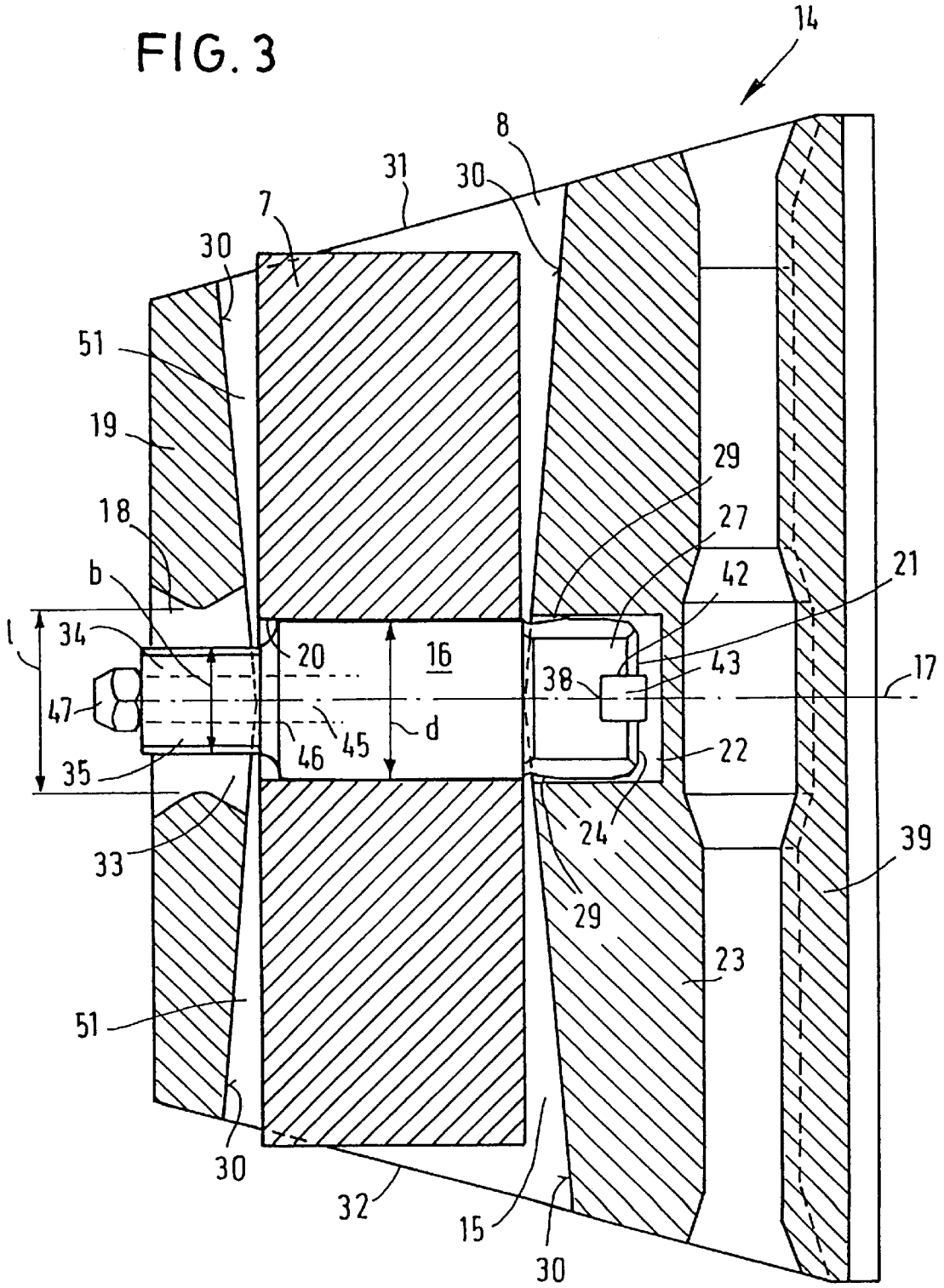
FIG. 3 is a section taken along the line III—III of FIG. 2.
Figure 4:
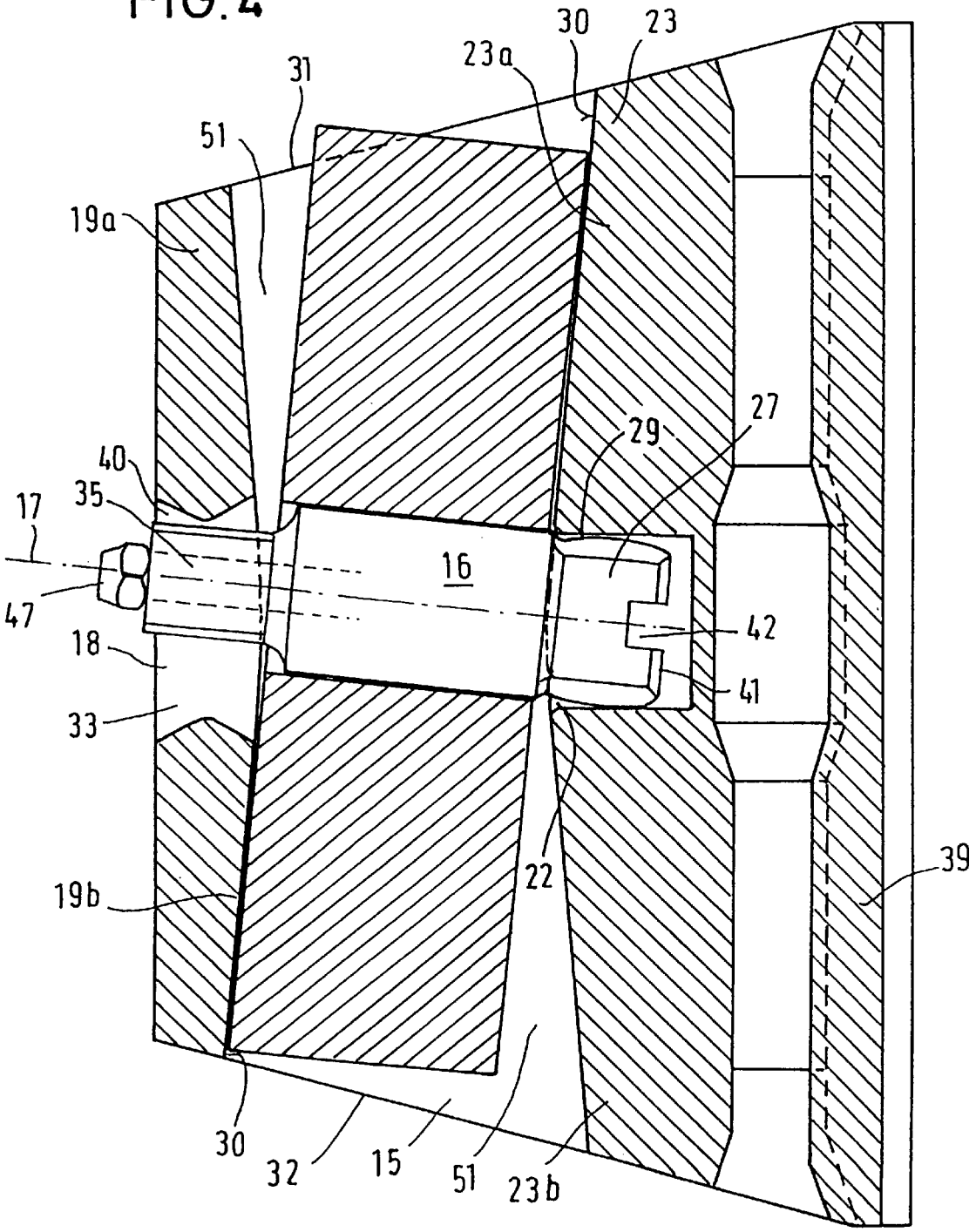
FIG. 4 corresponds to FIG. 3 but shows the guide block pivoted round a vertical axis.

The goaf-side end region 21 of the transverse bolt 16 which forms the pivot journal head 27 is flattened at its upper and lower sides 25, as shown best in FIGS. 2 and 4. The end region 21 forming the pivot journal head 27 has lateral guide faces 29 which are curved convexly from vertical axes 28 and of which the curvature is shown best in FIGS. 3 and 5. The guide faces 29 are simultaneously also curved around the axis of the transverse bolt 16, as shown in FIG. 6.

Owing to the above-described design, the pivot journal head 27 can pivot freely to a limited extent in the associated pivot journal socket 22, similarly to a ball joint in a ball socket, about a vertical axis 38 (see FIG. 2) in the plane of the horizontal axis 17 of the transverse bolt 16, that is a plane parallel to the floor and roof.

As shown in FIGS. 3 and 4, the lateral walls 19 and 23 of the pocket 15 are bevelled at their internal faces 30 directed toward the guide arm 7 so that the pocket 15 receives a diverging cross section issuing from the axis 17 of the transverse bolt 16 to the leading and trailing end 31 and 32. The play between the guide arm 7 and the lateral walls 19, 23 of the pocket 15 thus increases uniformly on both sides of the guide arm 7 starting from the transverse bolt 16 to the leading and trailing ends 31, 32.

As shown in FIG. 3, the orifice 18 in the mineral face-side lateral wall 19 is a slot with a length 1 greater than the diameter d of the transverse bolt 16 in the region of the bearing bore 20. The slot orifice 18 thus forms a horizontal guide 33 for the mineral-face-side end region 34 of the transverse bolt 16. The mineral-face-side end region 34 of the transverse bolt 16 is designed in the manner of a sliding block 35 with a substantially rectangular cross section resting on the upper and lower bearing faces 36, 37 of the horizontal guide 33. The width b of the block 35 however is smaller than the length 1 of the horizontal guide 33 so that it can move to and fro in the horizontal guide 33 in the longitudinal direction of the guide block 8 and in the direction of movement of the machine 1.

The above-described arrangement and mounting of the transverse bolt 16 with its pivot journal head 27 in the pivot journal socket 22 and the sliding block 35 in the opposing horizontal guide 33 allows the guide block 8 not only to pivot around the horizontal axis 17 of the transverse bolt relative to the guide arm 7 but also to be movable around the vertical axis 38 (see FIG. 2). This vertical axis 38 extends through the pivot journal head 27 and the goaf-side lateral wall 23 and therefore extends at only at a small lateral distance from the guide rail 9 beneath which the guide block 8 engages with the guide projection 39 for guidance of the cutting machine 1. Jamming of the guide block 8 in the guide rail 9 is very reliably avoided owing to the spatial proximity of the vertical pivot axis 38 to the guide rail 9 and the guide projection 39 engaging therewith.

FIG. 4 shows the guide block 8 mounted on the guide arm 7 in a position in which it has been pivoted by the maximum angle around the vertical axis 38 relative to the guide arm 7. In this position, one part 23*a* of the inner surface 30 of the goaf-side lateral wall 23 and the diametrically opposed part 19*b* of the inner surface 30 of the mineral-face-side lateral wall 19 act as contact faces which rest flat against the guide arm 7 whereas a correspondingly greater clearance has formed between the arm 7 and the other corresponding parts 19*a*, 23*b* of the inner surfaces 30 of the lateral walls 19, 23. It can be seen that the sliding block 35 of the transverse bolt 16 has not yet contacted the mineral-face-side lateral wall 19 at one end of the horizontal guide 33 but a small gap 40 still remains between the transverse bolt 16 and the lateral wall 19. This ensures that forces which occur as a result of intermittent stresses and can occur, for example during jamming of the guide block projection 39 in the guide rail 9 and have to be diverted via the guide arm 7 into the machine body 4, are not transmitted from the transverse bolt 16 but are carried off directly via the flat contact faces 19*b*, 23*a* of the lateral walls 19, 23 of the pocket 15 into the guide arm 7.

As shown best in FIGS. 5 and 6, the pivot journal head 27 is provided, at its end face 41, with a vertically extending groove 42 which serves for the positive reception of a locking element 43. In the embodiment illustrated, the locking element consists of a hammer head screw 44 of which the screw bolt 45 is plugged from the end face 41 of the transverse bolt 16 through a central through-bore 46 provided therein and is secured at the other end of the transverse bolt 16 at the end face of the sliding block 35 by a fastening nut 47. The hammer head 48 of the hammer head screw 44 projects downwardly beyond the pivot journal head 27 in the locked state and thus fits into an outlet orifice 49 arranged on the underside of the pivot journal socket 22 as shown in FIG. 2. To unlock the locking element 43 for removal of the guide block 8 connected to the transverse bolt 16 on the guide arm 7, the fastening nut 47 is simply released and the hammer head screw 44 is pushed into the through bore 46 until the hammer head 48 disengages from the groove 42 at the opposite end and can therefore be rotated through about 90° so that it no longer engages positively behind the stop face formed by the outlet orifice 49. The bolt 16 can then be drawn out. To simplify extraction of the transverse bolt 16, the mineral face-side end region of the bolt 16 on the end face of the sliding block 35 is provided with an extraction thread 52 on which a suitable extraction tool (bolt extractor), not shown, can be screwed to enable both the bolt 16 and the locking element 43 to be drawn out.

As shown in FIGS. 2, 3 and 4, a plurality of diverting orifices 51 for dust and fine material are provided in the guide block 8 on the underside of the pocket 15 which not only reliably prevent material from accumulating in the pocket 15 between the guide arm 7 and the lateral walls 23, 19 and thus from restricting the vertical and horizontal pivotability, but also help to keep the weight of the guide block 8 as low as possible. The outlet orifice 49 in the base of the pivot journal socket 22 can also discharge fine material.

The entire guide block 8 can be produced from cast steel, and subsequent machining and other mechanical treatment can be dispensed with if casting moulds of sufficiently high accuracy are used.

The invention is not restricted to the embodiment described and illustrated but many variations and modifications are possible without departing from the scope of the invention. For example, it would be conceivable to ensure the pivotal mounting of the pivot journal head 27 in the pivot journal socket 22 not by the special shape of the pivot journal head 27 itself which is able to move in a ball socket in the manner of a ball head in the embodiment, but to provide a separate stub axle which is placed through corresponding bores in the goaf-side lateral wall and the pivot journal head 27. The separate locking element 43 could also be dispensed with in such an embodiment because the transverse bolt 16 would then be held securely in the guide block 8 by the additional axle.

Instead of securing of the transverse bolt 16 in the described embodiment by means of the hammer head screw 43, other methods of securing can be adopted. For example, a plate can cover the horizontal guide 33 on the exterior of the mineral-face-side lateral wall 19. This plate can be screwed on the outside of the wall 19 and then reliably prevents the transverse bolt 16 from becoming detached from the side. A plate of this type would also have the additional advantage that fine dust cannot enter the horizontal guide 33 from the mineral-face-side.

What is claimed is:

1. In a mineral mining installation composed of a drum-type cutting machine which runs back and forth, over a conveyor alongside a mineral face in a mine working, an improved guide arrangement comprising a guide block which is pivotally connected on a guide arm of the cutting machine for movement around a horizontal and a vertical axis and cooperates with a guide rail arranged on the conveyor, wherein the guide arm fits into a pocket on the guide block and is secured therein by means of a transverse bolt, a pivot journal head is formed at one end region of the transverse bolt and is received pivotally relative to the guide block around a vertical axis in a pivot journal socket in a lateral wall of the pocket and a horizontal guide is formed in the other lateral wall of the pocket which receives the other end region of the transverse bolt with lateral play.

2. An installation according to claim 1, wherein the guide block has a projection which engages in the guide rail in the vicinity of the pivot journal socket.

3. An installation according to claim 1, wherein the pivot journal head possesses lateral guide faces which are convexly curved.

4. An installation according to claim 1, wherein the pivot journal head and the pivot journal socket are flattened on their upper and lower surfaces.

5. An installation according to claim 1, wherein the pivot journal socket is provided with at least one outlet orifice on its underside.

6. An installation according to claim 1, wherein the transverse bolt is secured in the pivot journal socket by means of a securing element.

7. An installation according to claim 6, wherein the securing element is a locking element which is arranged on the pivot journal head and fits into an outlet orifice at the underside of the pivot journal socket.

8. An installation according to claim 1, wherein a sliding block which is flattened at the top and bottom and is laterally displaceable in the horizontal guide is formed on an end region of the transverse bolt fitting in the horizontal guide.

9. An installation according to claim 1, wherein the lateral walls of the pocket have inclined contact faces engagable with the guide arm.

10. An installation according to claim 9, wherein the length of the horizontal guide and the angle of the inclined extending contact faces is dimensioned such that, during the pivoting of the guide block around a vertical axis, the guide arm with its lateral faces comes into contact with some of the contact faces before the end region of the transverse bolt fitted in the horizontal guide strikes a leading or trailing end of the horizontal guide.

11. An installation according to claim 1, wherein the pocket contains diverting orifices for the passage of fine material.

12. An installation according to claim 1, wherein the pivot journal socket is a blind bore in one lateral wall of the pocket.

13. An installation according to claim 7, wherein the pivot journal head comprises an approximately vertically extending holding groove for receiving the locking element.

14. An installation according to claim 13, wherein the locking element has a hammer head held positively in the holding groove in the locking position.

15. An installation according to claim 7, wherein the transverse bolt is provided with a central through-bore for receiving a fastening screw bolt of the locking element.

16. An installation according to claim 15, wherein the end region of the transverse bolt received in the horizontal guide has coupling means for coupling to a bolt extractor which can be connected to an end face of the bolt to enable the bolt to be withdrawn from the guide block.

17. An installation according to claim 16, wherein the coupling means is an extraction thread arranged on an end face of the bolt.

18. An installation according to claim 1, wherein the height of the end region of the bolt received in the horizontal guide is at least as great as the diameter of the transverse bolt in the region of the guide arm.

19. An installation according to claim 3, wherein the guide faces of the pivot journal head are also curved around the axis of the transverse bolt.

20. An installation according to claim 19, wherein the pivot journal socket forms lateral bearing faces for supporting the pivot journal guide faces, the bearing faces having a curvature adapted to the curvature of the guide faces.

21. An installation according to claim 1, wherein the guide block is a casting.

22. A mineral mining installation comprising a conveyor extending alongside a mineral face, a drum-type cutting machine with a body adapted to move back and forth over the conveyor to strip mineral from the mineral face which is transported by the conveyor, a drivably rotatable sprocket wheel supported on the machine body which meshes with a track on the conveyor in order to propel the machine along the conveyor and a guide arrangement for guiding the cutting machine along the conveyor, the guide arrangement comprising a guide rail mounted on the conveyor on the side thereof remote from the mineral face, vertical guide arms provided at the ends of the machine body relative to its direction of travel, a guide block mounted at the lower end of each of the arms and having a guide projection slidably engaging in a channel in the guide rail, said channel extending along the conveyor, a pocket in each guide block and defined by lateral walls, the pocket receiving the lower end of the associated guide arm with inner surfaces of the lateral walls providing contact faces for engaging with the guide arm, a transverse coupling member which extends through a bearing bore in the lower end of the guide arm, the coupling member defining a longitudinal horizontal axis about which the guide arm is pivotable, the coupling member having first and second end regions, the first end region of the coupling member forming a pivot journal head with curved guide faces and flattened upper and lower faces, a pivot journal socket with complementary curved surfaces in one of the lateral walls of the pocket remote from the mineral face and adjacent the guide projection, the pivot head being engaged in the pivot journal socket, for pivoting about a vertical axis, the second end region of the coupling member forming a sliding block of rectangular configuration, a slot in the other of the lateral walls of the pocket adjacent the mineral face, the sliding block engaging in the slot and being guided for horizontal displacement whereby each guide arm can move relative to the associated guide block about the longitudinal horizontal axis extending transversally of the conveyor and the direction of movement of the machine and defined by the coupling member and the vertical axis offset from the guide arm and defined by the pivot journal head and socket and in a horizontal plane defined by the sliding block and the slot and limited by engagement of the contact faces of the lateral walls of the pocket with surfaces of the guide arm.

* * * * *